US008635860B1

(12) United States Patent
Robinson

(10) Patent No.: US 8,635,860 B1
(45) Date of Patent: Jan. 28, 2014

(54) INTERNAL COMBUSTION ENGINE HEAT TRANSFER SYSTEM

(76) Inventor: Ralph P. Robinson, Belcamp, MD (US)

( * ) Notice: Subject to any disclaimer, the term of this patent is extended or adjusted under 35 U.S.C. 154(b) by 176 days.

(21) Appl. No.: 13/358,726

(22) Filed: Jan. 26, 2012

Related U.S. Application Data

(60) Provisional application No. 61/438,677, filed on Feb. 2, 2011.

(51) Int. Cl.
*F01N 3/00* (2006.01)

(52) U.S. Cl.
USPC ..... 60/298; 60/320

(58) Field of Classification Search
USPC ..... 60/274, 298, 320
See application file for complete search history.

(56) References Cited

U.S. PATENT DOCUMENTS

| | | | |
|---|---|---|---|
| 5,108,817 | A | 4/1992 | Kidd et al. |
| 5,285,752 | A | 2/1994 | Reed et al. |
| 7,152,633 | B2 | 12/2006 | White |
| 7,851,069 | B2 | 12/2010 | Starr |
| 2006/0272795 | A1 | 12/2006 | Horvat et al. |
| 2008/0041501 | A1 | 2/2008 | Platek et al. |

*Primary Examiner* — Thomas Denion
*Assistant Examiner* — Philip Eklem

(57) ABSTRACT

A system for reversing heat transfer from an exhaust system assembly on a vehicle comprising an engine block assembly and transaxle assembly operatively connected and located in an engine compartment of an automobile. The system comprises a number one exhaust manifold stay mount, a number two exhaust manifold stay mount, and a front exhaust collector pipe bracket and stay mount. The system comprises an exhaust system with a front exhaust collector pipe located beneath the engine block assembly. The system comprises an engine block assembly heat shield with a cross-section generally comprising the shape of a "U" that is located next to the surface of the engine block assembly. The engine block assembly heat shield is located over and overlays the front exhaust collector pipe bracket and stay mount, the number one exhaust manifold stay mount, and the number two exhaust manifold stay mount.

3 Claims, 3 Drawing Sheets

INTERNAL COMBUSTION ENGINE HEAT TRANSFER SYSTEM

CROSS REFERENCE

This application claims priority to U.S. provisional application Ser. No. 61/438,677 filed Feb. 2, 2011, the specification of which is incorporated herein by reference in its entirety.

BACKGROUND OF THE INVENTION

Since the invention of the internal combustion engine, various methods to control the damaging heat produced by the operation of the engine have been explored. Among the byproducts of heat generated from friction of the internal components coupled with the heat generated from the exhaust gasses is reduced life of the engine and reduced efficiency of the operating components. The present invention teaches a system of reversing a series of mechanisms of heat transfer to reduce operational issues of an automobile engine.

SUMMARY

The present invention features a system for reversing heat transfer from an exhaust system assembly on a vehicle comprising an engine block assembly and transaxle assembly operatively connected and located in an engine compartment of an automobile.

In some embodiments, the system comprises a number one exhaust manifold stay mount located on a first side of the engine block assembly, a number two exhaust manifold stay mount located on a second side of the engine block assembly, and a front exhaust collector pipe bracket and stay mount located on a bottom side of the engine block assembly.

In some embodiments, the system comprises an exhaust system comprising a number one exhaust manifold located on a first side of the engine block assembly that is operatively attached to the engine block assembly via a plurality of exhaust manifold bolts. In some embodiments, the system comprises a number two exhaust manifold located on a second side of the engine block assembly that is operatively attached to the engine block assembly via a plurality of exhaust manifold bolts. In some embodiments, the system comprises a front exhaust collector pipe located beneath the engine block assembly that is operatively attached to the number one exhaust manifold and the number two exhaust manifold.

In some embodiments, the system comprises an engine block assembly heat shield with a cross-section generally comprising the shape of "U". In some embodiments, the engine block assembly heat shield is located next to the surface of the engine block assembly.

In some embodiments, the lower member of the engine block assembly heat shield is located over and overlays the front exhaust collector pipe bracket and stay mount and is generally located between the engine block assembly and a front exhaust collector pipe. In some embodiments, the first panel of the engine block assembly heat shield is located over and overlays the number one exhaust manifold stay mount and is generally located between a body of the number one exhaust manifold and the first side of the engine block assembly. In some embodiments, the second panel of the engine block assembly heat shield is located over and overlays the number two exhaust manifold stay mount and is generally located between a body of a number two exhaust manifold and the second side of the engine block assembly.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 2:
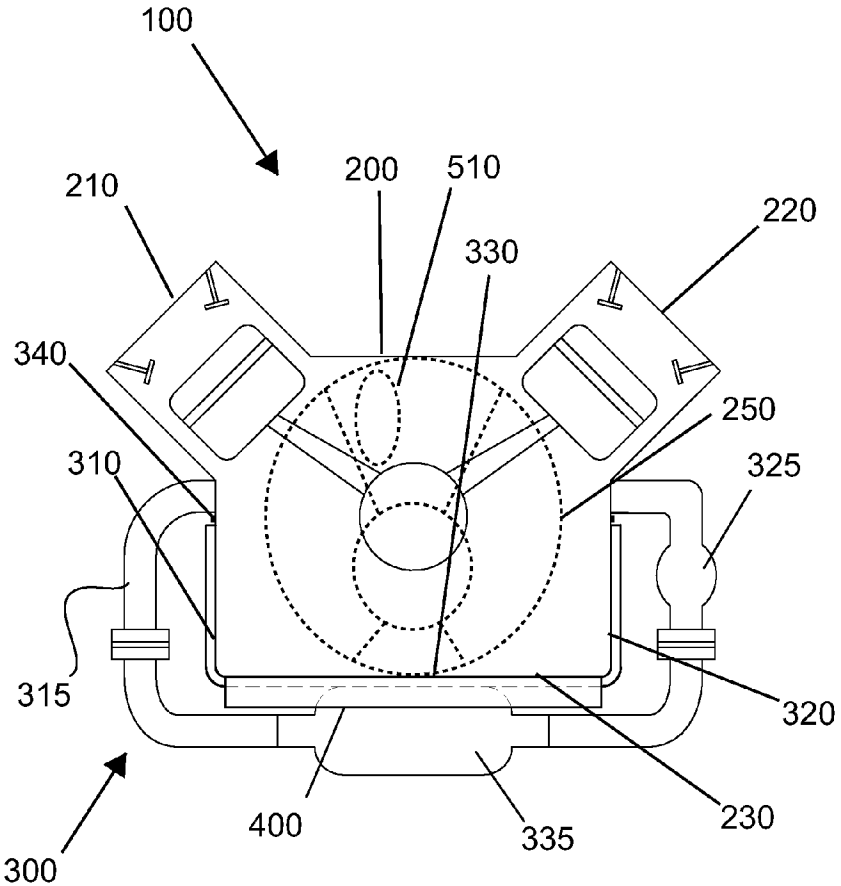
FIG. 2 is a side view of the engine block assembly of the present invention.
Figure 1:
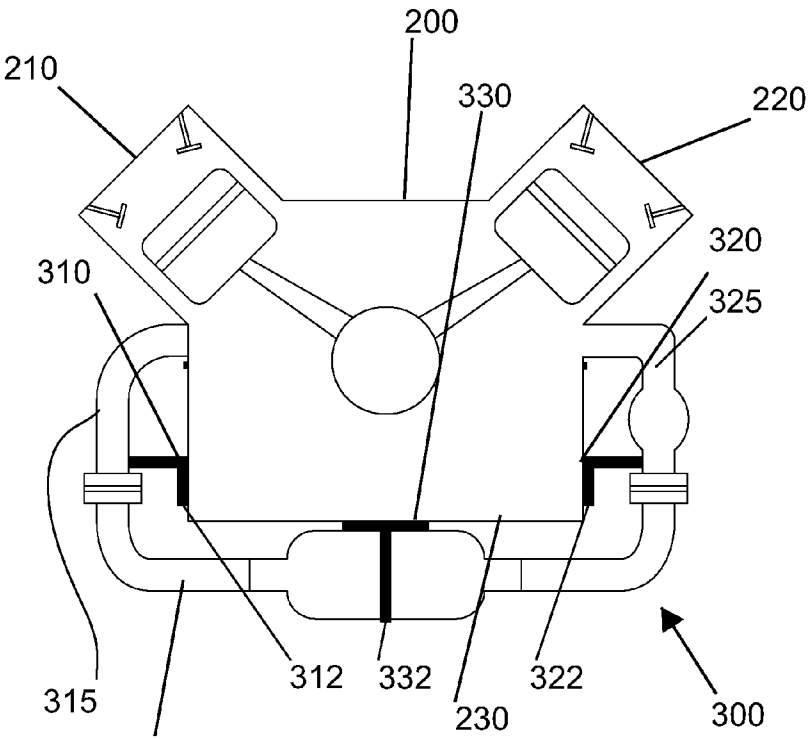
FIG. 1 is a side view of the engine block assembly of the present invention.
Figure 3:
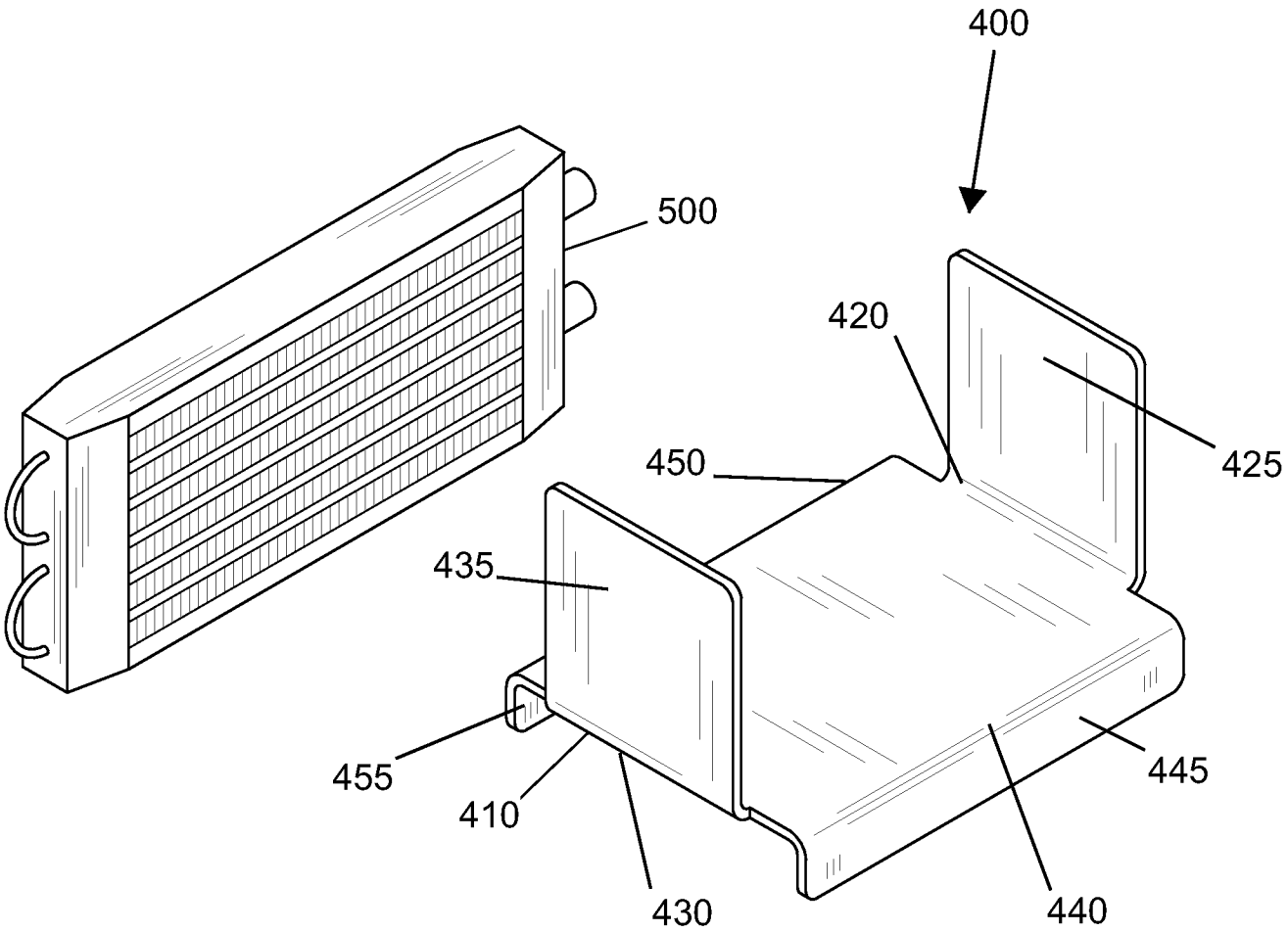
FIG. 3 is a perspective view of the components of the present invention
Figure 4:
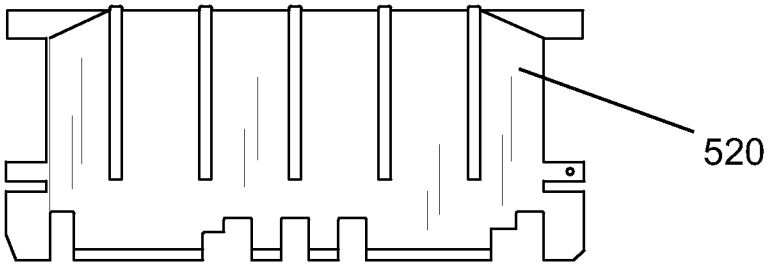
FIG. 4 is a bottom view of an engine splash shield of the present invention.

Following is a list of elements corresponding to a particular element referred to herein:

100 Heat transfer reversing system
200 Engine block assembly
210 Engine block assembly first side
220 Engine block assembly second side
230 Engine block assembly bottom side
250 Transaxle assembly
300 Exhaust system assembly
310 Number one exhaust manifold stay mount
312 Number one exhaust manifold stay
315 Number one exhaust manifold
320 Number two exhaust manifold stay mount
322 Number two exhaust manifold stay
325 Number two exhaust manifold
330 Front exhaust collector pipe bracket and stay mount
332 Front exhaust collector pipe bracket and stay
335 Front exhaust collector pipe
340 Exhaust manifold bolt
400 Engine block assembly heat shield
410 Lower member
420 Lower member first edge
425 First panel
430 Lower member second edge
435 Second panel
440 Lower member third edge
445 Third edge extension
450 Lower member fourth edge
455 Fourth edge extension
500 Transmission oil cooler
510 Transaxle shield
520 Engine splash shield Referring now to FIG. 1-4, the present invention features a heat transfer reversing system (100) for reversing heat transfer from an exhaust system assembly (300) to an engine block assembly (200) and a transaxle assembly (250) on a vehicle. In some embodiments, the system (100) comprises an engine block assembly (200) and transaxle assembly (250) operatively connected and located in an engine compartment of an automobile. In some embodiments, the engine block assembly (200) comprises a number one exhaust manifold stay mount (310) located on an engine block assembly first side (210), a number two exhaust manifold stay mount (320) located on an engine block assembly second side (220), and a front exhaust collector pipe bracket and stay mount (330) located on an engine block assembly bottom side (230).

In some embodiments, the system (100) comprises an exhaust system assembly (300). In some embodiments the exhaust system assembly (300) comprises a number one exhaust manifold (315) located on an engine block assembly first side (210), where the number one exhaust manifold (315) is operatively attached to the engine block assembly (200) via a plurality of exhaust manifold bolts (340). In some embodiments, the exhaust system assembly (300) comprises a number two exhaust manifold (325) located on an engine block assembly second side (220), where the number two exhaust manifold (325) is operatively attached to the engine block assembly (200) via a plurality of exhaust manifold bolts (340). In some embodiments, the exhaust system assembly (300) comprises a front exhaust collector pipe (335) located beneath the engine block assembly bottom side (230), where a front exhaust collector pipe (335) is operatively attached to the number one exhaust manifold (315) and the number two exhaust manifold (325).

In some embodiments, the number one exhaust manifold stay (312) is removed from the number one exhaust manifold stay mount (310) and the number one exhaust manifold (315). In some embodiments, the number two exhaust manifold stay (322) is removed from the number one exhaust manifold stay mount (320) and the number two exhaust manifold (325). In some embodiments, the front exhaust collector pipe bracket and stay (332) is removed from the front exhaust collector pipe bracket and stay mount (330) and the front exhaust collector pipe (335).

In some embodiments, the system comprises an engine block assembly heat shield (400). In some embodiments, the engine block assembly heat shield (400) comprises a generally horizontally planar lower member (410) having a lower member first edge (420), a lower member second edge (430), a lower member third edge (440), and a lower member fourth edge (450). In some embodiments, the engine block assembly heat shield (400) comprises a planar first panel (425) located at a lower member first edge (420) located at an upward angle with respect 10 the lower member (410), a planar second panel (435) located at a lower member second edge (430) opposite the lower member first edge (420) located at an upward angle with respect to the lower member (410), a planar third edge extension (445) located at a lower member third edge (440) between the lower member first edge (420) and the lower member second edge (430) located at a downward angle with respect to the lower member (410), and a planar fourth edge extension (455) located at a lower member fourth edge (450) opposite the third edge extension (445) located at a downward angle with respect to the lower member (410).

In some embodiments, a cross-section of the engine block assembly heat shield (400) on a coronal plane generally comprises the shape of a "U". In some embodiments, the engine block assembly heat shield (400) is constructed from a metal. In some embodiments, the engine block assembly heat shield (400) is constructed from aluminum. In some embodiments, the engine block assembly heat shield (400) is constructed from a composite material. In some embodiments, the engine block assembly heat shield (400) is constructed from a reflective insulation.

In some embodiments, the engine block assembly heat shield (400) is located next to a surface of the engine block assembly (200). In some embodiments, the lower member (410) is located over and overlays the front exhaust collector pipe bracket and stay mount (330). In some embodiments, the lower member (410) is located between the engine block assembly (200) and a front exhaust collector pipe (335). In some embodiments, the first panel (425) is located over and overlays the number one exhaust manifold stay mount (310). In some embodiments, the first panel (425) is generally located between a surface of the number one exhaust manifold (315) and the engine block assembly first side (210). In some embodiments, the second panel (435) is located over and overlays the number two exhaust manifold stay mount (320). In some embodiments, the second panel (435) is located between a surface of the number two exhaust manifold (325) and the engine block assembly second side (220).

In some embodiments, the engine block assembly heat shield (400) is located less than 0.25" from the surface of the engine block assembly (200). In some embodiments, the engine block assembly heat shield (400) is located between 0.25" and 0.5" from the surface of the engine block assembly (200). In some embodiments, the engine block assembly heat shield (400) is located between 0.5" and 0.75" from the surface of the engine block assembly (200). In some embodiments, the engine block assembly heat shield (400) is located between 0.75" and 1.0" from the surface of the engine block assembly (200). In some embodiments, the engine block assembly heat shield (400) is located more than 1.0" from the surface of the engine block assembly (200).

In some embodiments, the engine block assembly heat shield (400) is less than 6" wide from the lower member first edge (420) to the lower member second edge (430). In some embodiments, the engine block assembly heat shield (400) is between 6" wide and 12" wide from the lower member first edge (420) to the lower member second edge (430). In some embodiments, the engine block assembly heat shield (400) is greater than 12" wide from the lower member first edge (420) to the lower member second edge (430).

In some embodiments, the engine block assembly heat shield (400) is less than 6" long from the lower member third edge (440) to the lower member fourth edge (450). In some embodiments, the engine block assembly heat shield (400) is between 6" wide and 12" long from the lower member third edge (440) to the lower member fourth edge (450). In some embodiments, the engine block assembly heat shield (400) is greater than 12" long from the lower member third edge (440) to the lower member fourth edge (450).

In some embodiments, the system (100) further comprises a transmission oil cooler (500) operatively located on the transaxle assembly (250). In some embodiments, the transmission oil cooler (500) is sized according to the manufacturer's recommendations. In some embodiments, the transmission oil cooler (500) is installed according to the manufacturer's instructions. In some embodiments, the transmission oil cooler (500) is installed on the radiator of the automobile.

In some embodiments, the system (100) further comprises an engine oil cooler operatively located on the engine block assembly (200). In some embodiments, the engine oil cooler is sized according to the manufacturer's recommendations. In some embodiments, the engine oil cooler is installed according to the manufacturer's instructions.

In some embodiments, a method of reversing heat transfer from an exhaust system assembly (300) to an engine block assembly (200) and a transaxle assembly (250) of a vehicle comprises removal of the following components: a number one exhaust manifold stay (312) located on an engine block assembly first side (210), a number two exhaust manifold stay (322) located on an engine block assembly second side (220), a front exhaust collector pipe bracket and stay (332) located on an engine block assembly bottom side (230), a transaxle shield (510) located on the transaxle assembly (250), and an engine splash shield (520) located beneath a front exhaust collector pipe (335).

In some embodiments, a method of reversing heat transfer from an exhaust system assembly (300) to an engine block assembly (200) and a transaxle assembly (250) of a vehicle comprises modification of the following component: a fender splash shield located in a wheel well. The modification includes forming a plurality of ventilation slots in the fender splash shield. In some embodiments, the ventilation slots are cut into the fender splash shield. In some embodiments, the ventilation slots are drilled into the fender splash shield.

In some embodiments, a method of reversing heat transfer from an exhaust system assembly (300) to an engine block assembly (200) and a transaxle assembly (250) of a vehicle comprises installation of the following components: a transmission oil cooler (500) operatively located on the transaxle assembly (250), and an engine block assembly heat shield (400) comprising a generally horizontally planar lower member (410) having a lower member first edge (420), a lower member second edge (430), a lower member third edge (440), and a lower member fourth edge (450), wherein the engine block assembly heat shield (400) further comprises a planar first panel (425) located at a lower member first edge (420) located at an upward angle with respect to the lower member (410), a planar second panel (435) located at a lower member second edge (430) apposite the lower member first edge (420) located at an upward angle with respect to the lower member (410), a planar third edge extension (445) located at a lower member third edge (440) between the lower member first edge (420) and the lower member second edge (430) located at a downward angle with respect to the lower member (410), and a planar fourth edge extension (455) located at a lower member fourth edge (450) opposite the third edge extension (445) located at a downward angle with respect to the lower member (410), wherein a cross-section of the engine block assembly heat shield (400) on a coronal plane generally comprises the shape of a "U", wherein the engine block assembly heat shield (400) is located next to a surface of the engine block assembly (200), wherein the lower member (410) is located over and overlays the front exhaust collector pipe bracket and stay mount (330), wherein the lower member (410) is located between the engine block assembly (200) and a front exhaust collector pipe (335), wherein the first panel (425) is located over and overlays the number one exhaust manifold stay mount (310), wherein the first panel (425) is generally located between a surface of the number one exhaust manifold (315) and the engine block assembly first side (210), wherein the second panel (435) is located over and overlays the number two exhaust manifold stay mount (320), wherein the second panel (435) is located between a surface of the number two exhaust manifold (325) and the engine block assembly second side (220).

In some embodiments, an engine block assembly comprises a Toyota VVT-i internal combustion engine with variable valve timing.

As used herein, the term "about" refers to plus or minus 10% of the referenced number. For example, an embodiment wherein the heat shield is about 10 inches in length includes a heat shield that is between 9 and 11 inches in length.

In some embodiments, a method of reversing heat transfer from an exhaust system assembly (300) to an engine block assembly (200) and a transaxle assembly (250) of a vehicle is defined as a method of reducing heat transfer from an exhaust system assembly (300) to an engine block assembly (200) and a transaxle assembly (250) of a vehicle. In some embodiments, a system of reversing heat transfer from an exhaust system assembly (300) to an engine block assembly (200) and a transaxle assembly (250) of a vehicle is defined as a system of reducing heat transfer from an exhaust system assembly (300) to an engine block assembly (200) and a transaxle assembly (250) of a vehicle.

The disclosures of the following U.S. patents are incorporated in their entirety by reference herein: U.S. Pat. No. 5,285,752; U.S. Pat. No. 5,108,817; U.S. Pat. No. 7,152,633; U.S. Pat. No. 7,851,069; U.S. Pat. Application No. 2006/0272795; US. Pat. Application No. 2008/0041501.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it with be readily apparent to those skilled in the an that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A heat transfer reversing system (100) for reversing heat transfer from an exhaust system assembly (300) to an engine block assembly (200) and a transaxle assembly (250) on a vehicle comprising:

(a) the engine block assembly (200) and transaxle assembly (250) operatively connected and disposed in an engine compartment of an automobile said engine block assembly (200) comprising:

(i) a number one exhaust manifold stay mount (310) disposed on an engine block assembly first side (210), (ii) a number two exhaust manifold stay mount (320) disposed on an engine block assembly second side (220), and (iii) a front exhaust collector pipe bracket and stay mount (330) disposed on an engine block assembly bottom side (230);

(b) the exhaust system assembly (300) comprising:

(i) a number one exhaust manifold (315) disposed on the engine block assembly first side (210), wherein the number one exhaust manifold (315) is operatively attached to the engine block assembly (200) via a plurality of exhaust manifold bolts (340), (ii) a number two exhaust manifold (325) disposed on the engine block assembly second side (220), wherein the number two exhaust manifold (325) is operatively attached to the engine block assembly (200) via the plurality of exhaust manifold bolts (340), and (iii) a front exhaust collector pipe (335) disposed beneath the engine block assembly bottom side (230), wherein the front exhaust collector pipe (335) is operatively attached to the number one exhaust manifold (315) and the number two exhaust manifold (325); and (c) an engine block assembly heat shield (400) comprising (i) a generally horizontally planar lower member (410) having a lower member first edge (420), a lower member second edge (430), a lower member third edge (440), and a lower member fourth edge (450), (ii) a planar first panel (425) disposed at the lower member first edge (420) disposed at an upward angle with respect to the lower member (410), (iii) a planar second panel (435) disposed at the lower member second edge (430) opposite the lower member first edge (420) disposed at an upward angle with respect to the lower member (410), (iv) a planar third edge extension (445) disposed at the lower member third edge (440) between the lower member first edge (420) and the lower member second edge (430) disposed at a downward angle with respect to the lower member (410), and (v) a planar fourth edge extension (455) disposed at the lower member fourth edge (450) opposite the third edge extension (445) disposed at a downward angle with respect to the lower member (410), wherein a cross-section of the engine block assembly heat shield (400) on a coronal plane generally comprises a shape of a "U", wherein the engine block assembly heat shield (400) is disposed next to a surface of the engine block assembly (200), wherein the lower member (410) is disposed over and overlays the front exhaust collector pipe bracket and stay mount (330), wherein the lower member (410) is disposed between the engine block assembly (200) and the front exhaust collector pipe (335), wherein the first panel (425) is disposed over and overlays the number one exhaust manifold stay mount (310), wherein the first panel (425) is generally disposed between a surface of the number one exhaust manifold (315) and the engine block assembly first side (210), wherein the second panel (435) is disposed over and overlays the number two exhaust manifold stay mount (320), wherein the second panel (435) is disposed between a surface of the number two exhaust manifold (325) and the engine block assembly second side (220).

2. The system (100) of claim 1, wherein the system (100) further comprises a transmission oil cooler (500) operatively connected to the transaxle assembly (250).

3. A method of reversing heat transfer from an exhaust system assembly (300) to an engine block assembly (200) and a transaxle assembly (250) of a vehicle comprising:

(a) removing a number one exhaust manifold stay (312) disposed on an engine block assembly first side (210);

(b) removing a number two exhaust manifold stay (322) disposed on an engine block assembly second side (220);

(c) removing a front exhaust collector pipe bracket and stay (332) disposed on an engine block assembly bottom side (230);

(d) removing a transaxle shield (510) disposed on the transaxle assembly (250);

(e) removing an engine splash shield (520) disposed beneath a front exhaust collector pipe (335);

(f) modifying a fender splash shield disposed in a wheel well by forming a plurality of ventilation slots therein;

(g) installing a transmission oil cooler (500) operatively connected to the transaxle assembly (250); and (h) installing an engine block assembly heat shield (400) comprising a generally horizontally planar lower member (410) having a lower member first edge (420), a lower member second edge (430), a lower member third edge (440), and a lower member fourth edge (450), wherein the engine block assembly heat shield (400) further comprises a planar first panel (425) disposed at the lower member first edge (420) disposed at an upward angle with respect to the lower member (410), a planar second panel (435) disposed at the lower member second edge (430) opposite the lower member first edge (420) disposed at an upward angle with respect to the lower member (410), a planar third edge extension (445) disposed at the lower member third edge (440) between the lower member first edge (420) and the lower member second edge (430) disposed at a downward angle with respect to the lower member (410), and a planar fourth edge extension (455) disposed at the lower member fourth edge (450) opposite the third edge extension (445) disposed at a downward angle with respect to the lower member (410), wherein a cross-section of the engine block assembly heat shield (400) on a coronal plane generally comprises a shape of a "U", wherein the engine block assembly heat shield (400) is disposed next to a surface of the engine block assembly (200), wherein the lower member (410) is disposed over and overlays a front exhaust collector pipe bracket and stay mount (330), wherein the lower member (410) is disposed between the engine block assembly (200) and the front exhaust collector pipe (335), wherein the first panel (425) is disposed over and overlays a number one exhaust manifold stay mount (310), wherein the first panel (425) is generally disposed between a surface of a number one exhaust manifold (315) and the engine block assembly first side (210), wherein the second panel (435) is disposed over and overlays a number two exhaust manifold stay mount (320), wherein the second panel (435) is disposed between a surface of a number two exhaust manifold (325) and the engine block assembly second side (220).

* * * * *